US005864878A

United States Patent [19]

Mashrick

[11] Patent Number: 5,864,878

[45] Date of Patent: Feb. 2, 1999

[54] CLEAR GARMENT PROTECTOR WITH ATTACHED NAPKIN

[76] Inventor: Morna J. Mashrick, 37 Century La., Milton, Mass. 02186

[21] Appl. No.: 70,652

[22] Filed: Apr. 3, 1998

[51] Int. Cl.[6] ..... A41B 13/10

[52] U.S. Cl. ..... 2/46; 2/49.1; 2/51

[58] Field of Search ..... 2/46, 49.1, 49.4, 2/49.5, 48, 51

[56] References Cited

U.S. PATENT DOCUMENTS

| | | | |
|---|---|---|---|
| 1,257,810 | 2/1918 | Clark | 2/51 |
| 4,030,139 | 6/1977 | Sonntag | 2/51 |
| 4,306,316 | 12/1981 | Klepfer | 2/48 |
| 4,330,888 | 5/1982 | Klepfer | 2/48 |
| 4,423,523 | 1/1984 | Bodner et al. | 2/49.1 |
| 4,660,226 | 4/1987 | Quilling et al. | 2/49.1 |
| 4,754,500 | 7/1988 | Brucato et al. | 2/49.1 X |
| 5,062,158 | 11/1991 | Oka et al. | 2/46 |
| 5,454,119 | 10/1995 | Thomm | 2/49.2 X |

*Primary Examiner*—Gloria M. Hale

[57] ABSTRACT

A clear garment protector with attached napkin for protecting the clothes of a wearer from soiling. The inventive device includes a generally transparent main sheet having a generally arcuate neck cutout at the top edge of the main sheet. The neck cutout defines a pair of spaced apart shoulder flap portions on the main sheet adjacent the top edge of the main sheet such that the neck cutout is interposed between the shoulder flap portions. A napkin sheet is coupled to the bottom edge of the main sheet.

9 Claims, 2 Drawing Sheets

CLEAR GARMENT PROTECTOR WITH ATTACHED NAPKIN

BACKGROUND OF THE INVENTION

1. Field of the Invention

The present invention relates to garment protective covers and more particularly pertains to a new clear garment protector with attached napkin for protecting the clothes of a wearer from soiling.

2. Description of the Prior Art

The use of garment protective covers is known in the prior art. More specifically, garment protective covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art garment protective covers include U.S. Pat. Nos. 4,330,888; 5,062,158; 5,552,200; 5,031,241; 3,131,399; and 1,262,136.

Traditional bibs and aprons normally are fastened around the neck of a wearer. This causes a problem of injury to the wearer's neck when the bib or apron is pulled on (which commonly occurs in nursing homes).

While these devices fulfill their respective, particular objectives and requirements, the aforementioned patents do not disclose a new clear garment protector with attached napkin. The inventive device includes a generally transparent main sheet having a generally arcuate neck cutout at the top edge of the main sheet. The neck cutout defines a pair of spaced apart shoulder flap portions on the main sheet adjacent the top edge of the main sheet such that the neck cutout is interposed between the shoulder flap portions. A napkin sheet is coupled to the bottom edge of the main sheet.

In these respects, the clear garment protector with attached napkin according to the present invention substantially departs from the conventional concepts and designs of the prior art, and in so doing provides an apparatus primarily developed for the purpose of protecting the clothes of a wearer from soiling.

SUMMARY OF THE INVENTION

In view of the foregoing disadvantages inherent in the known types of garment protective covers now present in the prior art, the present invention provides a new clear garment protector with attached napkin construction wherein the same can be utilized for protecting the clothes of a wearer from soiling.

The general purpose of the present invention, which will be described subsequently in greater detail, is to provide a new clear garment protector with attached napkin apparatus and method which has many of the advantages of the garment protective covers mentioned heretofore and many novel features that result in a new clear garment protector with attached napkin which is not anticipated, rendered obvious, suggested, or even implied by any of the prior art garment protective covers, either alone or in any combination thereof.

To attain this, the present invention generally comprises a generally transparent main sheet having a generally arcuate neck cutout at the top edge of the main sheet. The neck cutout defines a pair of spaced apart shoulder flap portions on the main sheet adjacent the top edge of the main sheet such that the neck cutout is interposed between the shoulder flap portions. A napkin sheet is coupled to the bottom edge of the main sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clear garment protector with attached napkin apparatus and method which has many of the advantages of the garment protective covers mentioned heretofore and many novel features that result in a new clear garment protector with attached napkin which is not anticipated, rendered obvious, suggested, or even implied by any of the prior art garment protective covers, either alone or in any combination thereof.

It is another object of the present invention to provide a new clear garment protector with attached napkin which may be easily and efficiently manufactured and marketed.

It is a further object of the present invention to provide a new clear garment protector with attached napkin which is of a durable and reliable construction.

An even further object of the present invention is to provide a new clear garment protector with attached napkin which is susceptible of a low cost of manufacture with regard to both materials and labor, and which accordingly is then susceptible of low prices of sale to the consuming public, thereby making such clear garment protector with attached napkin economically available to the buying public.

Still yet another object of the present invention is to provide a new clear garment protector with attached napkin which provides in the apparatuses and methods of the prior art some of the advantages thereof, while simultaneously overcoming some of the disadvantages normally associated therewith.

Still another object of the present invention is to provide a new clear garment protector with attached napkin for protecting the clothes of a wearer from soiling.

Yet another object of the present invention is to provide a new clear garment protector with attached napkin which includes a generally transparent main sheet having a generally arcuate neck cutout at the top edge of the main sheet. The neck cutout defines a pair of spaced apart shoulder flap portions on the main sheet adjacent the top edge of the main sheet such that the neck cutout is interposed between the shoulder flap portions. A napkin sheet is coupled to the bottom edge of the main sheet.

Still yet another object of the present invention is to provide a new clear garment protector with attached napkin that easily pulls apart from the clothes of a wearer when pulled so that the pulling of the protector does not hurt the wearer.

Even still another object of the present invention is to provide a new clear garment protector with attached napkin that has a transparent portion for permitting viewing of a wearer clothes through the protector thereby helping to hide the wearing of the protector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
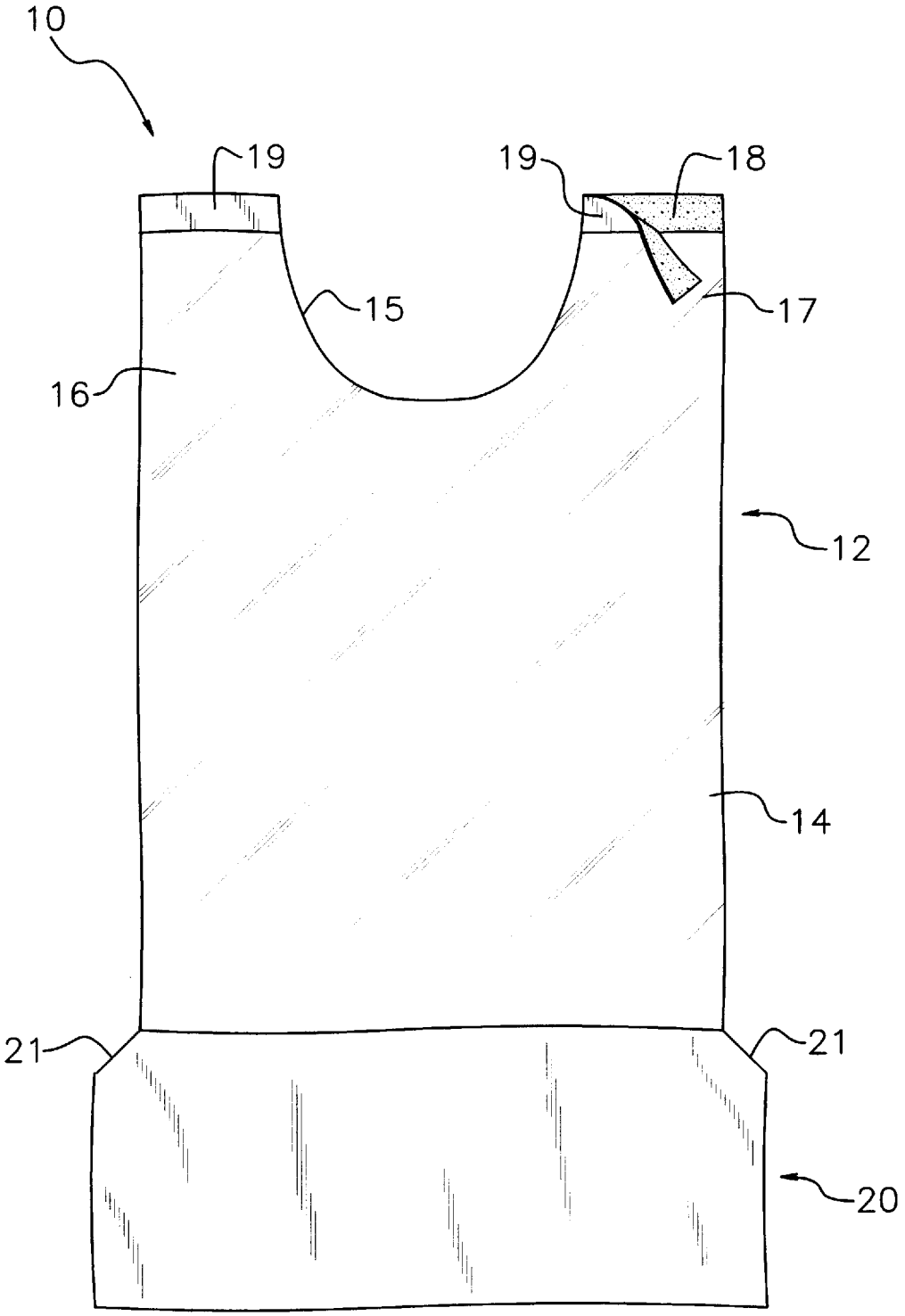
FIG. 1 is a schematic back side view of the present invention.
Figure 2:
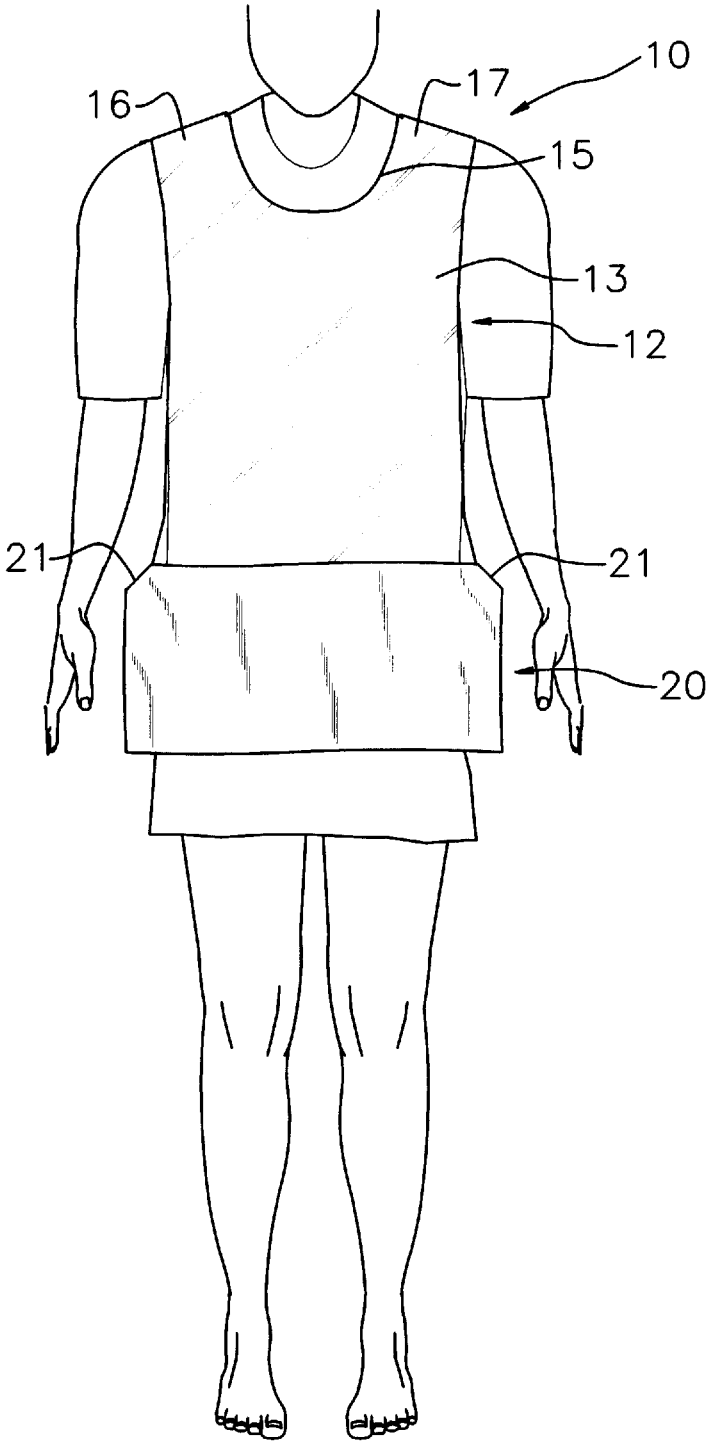
FIG. 2 is a schematic front side view of a new clear garment protector with attached napkin in use according to the present invention.

With reference now to the drawings, and in particular to FIGS. 1 through 2 thereof, a new clear garment protector with attached napkin embodying the principles and concepts of the present invention and generally designated by the reference numeral 10 will be described.

As best illustrated in FIGS. 1 through 2, the clear garment protector with attached napkin 10 generally comprises a generally transparent main sheet 12 having a generally arcuate neck cutout 15 at the top edge of the main sheet 12. The neck cutout 15 defines a pair of spaced apart shoulder flap portions 16,17 on the main sheet 12 adjacent the top edge of the main sheet 12 such that the neck cutout 15 is interposed between the shoulder flap portions 16,17. A napkin sheet 20 is coupled to the bottom edge of the main sheet 12.

In use, the clear garment protector with attached napkin 10 is designed for attachment to the front of a garment of a wearer. Specifically, the generally rectangular flexible main sheet 12 is generally transparent. The main sheet 12 has front and back surfaces 13,14, opposite top and bottom edges, and a pair of elongate side edges extending between the top and bottom edges of the main sheet 12. As illustrated in FIG. 2, the main sheet 12 is designed for positioning over the front of a garment of a wearer such that the back surface 14 of the main sheet 12 is positioned adjacent the garment of the wearer. The main sheet 12 has a length defined between the top and bottom edges. The main sheet 12 has a width defined between the side edges of the main sheet 12. The length of the main sheet 12 is greater than the width of the main sheet 12.

The main sheet 12 has a generally arcuate neck cutout 15 extending from the top edge towards the bottom edge. The neck cutout 15 is spaced apart generally equidistant from the side edges of the main sheet 12. As illustrated in FIG. 2, the cutout 15 is designed for positioning adjacent the neck of a wearer. The neck cutout 15 defining a pair of spaced apart shoulder flap portions 16,17 on the main sheet 12 adjacent the top edge of the main sheet 12 such that the neck cutout 15 is interposed between the shoulder flap portions 16,17. The shoulder flap portions 16,17 are designed for attachment to shoulder regions of a garment of a wearer. With reference to FIG. 1, the back surface 14 of each of the shoulder flap portions 16,17 of the main sheet 12 has an adhesive 18 provided thereon. The adhesive 18 is positioned on each of the shoulder flap portions 16,17 adjacent the top edge of the main sheet 12. The adhesive 18 is designed for adhesively attaching the back surface 14 of each of the shoulder flaps 16,17 to a garment of a wearer. Ideally, the adhesives are applied to the associated shoulder flap portion in an elongate strip along the top edge of the main sheet 12. Ideally, a protective strip 19 is provided to cover each of the adhesive strips.

The napkin sheet 20 is generally rectangular and has top and bottom edges, and a pair of side edges extending between the top and bottom edges of the napkin sheet 20. The top edge of the napkin sheet 20 is coupled to the bottom edge of the main sheet 12. One of the side edges of the napkin sheet 20 is outwardly extended from a line one of the side edges of the main sheet 12 lies along. Another of the side edges of the napkin sheet 20 is outwardly extended from line another of the side edges of the main sheet 12 lies along. The napkin has a pair of upper corners and a pair of lower corners. Ideally, each the upper corners of the napkin sheet 20 are chamfered to form a chamfered edge 21 that extend between their associated side edges of the napkin sheet 20 and the main sheet 12.

The napkin sheet 20 has a width defined between the side edges of the napkin sheet 20, the napkin sheet 20 has a length defined between the top and bottom edges of the napkin sheet 20. The width of the napkin sheet 20 is greater than the length of the napkin sheet 20. Preferably, the width of the napkin sheet 20 is greater than the width of the main sheet 12 and the length of the main sheet 12 is greater than the length of the napkin sheet 20. Ideally, the length of the main sheet 12 is greater than about three times the length of the napkin sheet 20. Also ideally, the width of the main sheet 12 is less than about seven-eighths the width of the napkin sheet 20. In an ideal illustrative embodiment,, the width of the main sheet 12 is about 2 feet and the overall length of the attachment defined between the top edge of the main sheet 12 and the bottom edge of the napkin sheet 20 is about 3 feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective cover attachment for attachment to the front of a garment of a wearer, said attachment comprising:

a main sheet being generally transparent, said main sheet having front and back surfaces, opposite top and bottom edges, and a pair of elongate side edges extending between said top and bottom edges of said main sheet;

said main sheet having a generally arcuate neck cutout extending from said top edge towards said bottom edge, said neck cutout being spaced apart from said side edges of said main sheet;

said neck cutout defining a pair of spaced apart shoulder flap portions on said main sheet adjacent said top edge of said main sheet such that said neck cutout is interposed between said shoulder flap portions;

a napkin sheet having top and bottom edges, and a pair of side edges extending between said top and bottom edges of said napkin sheet; and said top edge of said napkin sheet being coupled to said bottom edge of said main sheet.

2. The attachment of claim 1, wherein said main sheet has a length defined between said top and bottom edges, wherein said main sheet has a width defined between said side edges of said main sheet, wherein said napkin sheet has a width defined between said side edges of said napkin sheet, wherein said napkin sheet has a length defined between said top and bottom edges of said napkin sheet, said length of said main sheet being greater than said width of said main sheet, and wherein said width of said napkin sheet is greater than said length of said napkin sheet.

3. The attachment of claim 2, wherein said width of said napkin sheet is greater than said width of said main sheet, and wherein said length of said main sheet is greater than said length of said napkin sheet.

4. The attachment of claim 2, wherein said length of said main sheet is greater than about three times said length of said napkin sheet, and wherein said width of said main sheet is less than about seven-eighths said width of said napkin sheet.

5. The attachment of claim 1, wherein the back surface of each of said shoulder flap portions of said main sheet has an adhesive provided thereon, said adhesive being positioned on each of said shoulder flap portions adjacent said top edge of said main sheet, said adhesive being for attaching the back surface of each of said shoulder flaps to a garment of a wearer.

6. The attachment of claim 5, wherein said adhesives are applied to the associated shoulder flap portion in an elongate strip along said top edge of the main sheet.

7. The attachment of claim 1, wherein one of said side edges of said napkin sheet being outwardly extended from a line one of said side edges of said main sheet lies along, another of said side edges of said napkin sheet being outwardly extended from line another of said side edges of said main sheet lies along.

8. The attachment of claim 7, wherein said napkin has a pair of upper corners and a pair of lower corners, wherein each said upper corners of said napkin sheet are chamfered to form a chamfered edge, said chamfered edges of said napkin sheet extending between associated side edges of said napkin sheet and said main sheet.

9. A protective cover attachment for attachment to the front of a garment of a wearer, said attachment comprising:

a flexible main sheet being generally transparent, said main sheet having front and back surfaces, opposite top and bottom edges, and a pair of elongate side edges extending between said top and bottom edges of said main sheet;

said main sheet having a length defined between said top and bottom edges, said main sheet having a width defined between said side edges of said main sheet;

said length of said main sheet being greater than said width of said main sheet;

said main sheet having a generally arcuate neck cutout extending from said top edge towards said bottom edge, said neck cutout being spaced apart generally equidistant from said side edges of said main sheet;

said neck cutout defining a pair of spaced apart shoulder flap portions on said main sheet adjacent said top edge of said main sheet such that said neck cutout is interposed between said shoulder flap portions;

the back surface of each of said shoulder flap portions of said main sheet having an adhesive provided thereon, said adhesive being positioned on each of said shoulder flap portions adjacent said top edge of said main sheet, said adhesive being for attaching the back surface of each of said shoulder flaps to a garment of a wearer, wherein said adhesives are applied to the associated shoulder flap portion in an elongate strip along said top edge of the main sheet;

a napkin sheet being generally rectangular and having top and bottom edges, and a pair of side edges extending between said top and bottom edges of said napkin sheet, said top edge of said napkin sheet being coupled to said bottom edge of said main sheet;

said napkin sheet having a width defined between said side edges of said napkin sheet, said napkin sheet having a length defined between said top and bottom edges of said napkin sheet, wherein said width of said napkin sheet is greater than said length of said napkin sheet;

wherein said length of said main sheet is greater than about three times said length of said napkin sheet;

wherein said width of said main sheet is less than about seven-eighths said width of said napkin sheet;

one of said side edges of said napkin sheet being outwardly extended from a line one of said side edges of said main sheet lies along, another of said side edges of said napkin sheet being outwardly extended from line another of said side edges of said main sheet lies along; and said napkin having a pair of upper corners and a pair of lower corners, wherein each said upper corners of said napkin sheet are chamfered to form a chamfered edge, said chamfered edges of said napkin sheet extending between associated side edges of said napkin sheet and said main sheet.

* * * * *